US007726087B2

(12) United States Patent
Tankersley, Jr. et al.

(10) Patent No.: US 7,726,087 B2
(45) Date of Patent: Jun. 1, 2010

(54) INDUSTRIAL ROOFING SYSTEM AND METHOD

(75) Inventors: Francis Howard Tankersley, Jr., Tracy, CA (US); Adam Montez Rubio, Brentwood, CA (US)

(73) Assignee: California Nail & Supply Company, Livermore, CA (US)

( * ) Notice: Subject to any disclaimer, the term of this patent is extended or adjusted under 35 U.S.C. 154(b) by 956 days.

(21) Appl. No.: 11/424,590

(22) Filed: Jun. 16, 2006

(65) Prior Publication Data

US 2007/0289237 A1 Dec. 20, 2007

(51) Int. Cl.
*E04B 5/00* (2006.01)

(52) U.S. Cl. ..... 52/409; 52/747.11

(58) Field of Classification Search ..... 52/409, 52/746.11

See application file for complete search history.

(56) References Cited

U.S. PATENT DOCUMENTS

| | | | | |
|---|---|---|---|---|
| 1,418,377 | A * | 6/1922 | Jaynes | 52/420 |
| 2,153,887 | A * | 4/1939 | Greider et al. | 52/540 |
| 3,300,927 | A * | 1/1967 | Bettoli | 52/309.13 |
| 3,892,899 | A * | 7/1975 | Klein | 428/49 |
| 4,947,603 | A * | 8/1990 | Goertz | 52/309.4 |
| 5,099,627 | A * | 3/1992 | Coulton et al. | 52/408 |
| 5,174,128 | A * | 12/1992 | Bourne et al. | 62/373 |
| 6,872,440 | B1 | 3/2005 | Klik et al. | |
| 6,933,007 | B2 | 8/2005 | Fensel et al. | |
| 2003/0177705 | A1 * | 9/2003 | Forbis et al. | 52/3 |
| 2004/0013854 | A1 * | 1/2004 | Zanchetta et al. | 428/156 |

OTHER PUBLICATIONS

Akbari H. et al "Professional Roofing" www.professionalroofing.net, Oct. 1998.
Heat Island Group "Roof Heat Transfer" eetd.lbl.gov/heatisland/coolroots/overview/CoolRoots99-09.html, Jun. 16, 1999.
"Panelized Structures, Inc.", www.panelized.com.
"Roofing Membranes" eetd.lbl.gov/coolroof/membrane.htm.
"Roof Coatings" eetd.lbl.gov/coolroof/coating.htm.
"Lateral Load Connections for Low-Slope Roof Diaphragms" APA The Engineered Wood Association, pp. 1-23, Feb. 2004.

* cited by examiner

*Primary Examiner*—Brian E Glessner
*Assistant Examiner*—James J Buckle, Jr.
(74) *Attorney, Agent, or Firm*—Connolly Bove Lodge & Hutz LLP

(57) ABSTRACT

Metal tie straps create tension/compression connections between plywood or oriented strand board decking panels in portions or throughout the roof diaphragm of a typical panelized or built up roof system. Heat build up at such metal tie straps is minimized by installing a radiant reflective sheeting or cool seal over the metal tie strap before applying the roofing membrane over the sheeting and tie straps.

17 Claims, 2 Drawing Sheets

INDUSTRIAL ROOFING SYSTEM AND METHOD

BACKGROUND OF THE INVENTION

The present invention relates to industrial roofing, such as low slope roof diaphragms (Panelized Roof Systems) that are generally flat. Panelized Roof Systems can be installed over large or small warehouses. In these systems, roof sheathing comprises plywood or oriented strand board decking panels (generally 4 foot by 8 foot) with stiffeners pre-framed at 16 or 24 inches on center. The long dimension of each decking panel typically is oriented parallel to a support. Adjacent panel edges are placed over and nailed to common framing members. The roof forms a blocked diaphragm, which has significantly greater seismic and high wind resistance than conventionally framed roofs with unblocked sheathing. Various low slope roof diaphragm configurations are shown in the Engineered Wood Association publication "Lateral Load Connections for Low-Slope Roof Diaphragms", APA The Engineered Wood Association (2004).

Metal (usually galvanized steel) tie-straps are nailed over the roof decking (or sheathing) panels to transfer tension forces between two framing members. This creates a tension/compression connection from the wall to the inner portion of the diaphragm. This combination then is covered with built up roofing membrane usually comprising layers of felt, strapping, roofing tar and roofing shingles or rolls.

Typical roofing materials such as asphalt and modified bitumen and gravel can absorb more than seventy percent (70%) of the solar energy that falls upon them. Roofs having dark roofing materials, which tend to absorb more radiant or solar energy, may become as hot as 88° C. (190° F.) on a sunny day. Moreover, it has been reported that urban areas, such as Los Angeles, Calif., can record temperatures about 3 to 4° C. (6 to 8° F.) hotter than surrounding areas. These urban heat islands (i.e., differences in temperature between urban and rural areas) result in increased air-conditioning costs, energy use and pollution. (http://www.professionalroofing.net/past/oct98/feature.asp).

Metal tie straps (or continuity ties) are now required by building codes to be installed as support for roof regions of low-slope roofs near building side walls. In some cases the tie straps are installed onto decking panels throughout the roof diaphragm. Such metal tie straps conduct heat energy and cause the regions where such straps are found to become hotter than adjoining roof regions. Such excessive heating leads to "hot spots" where the asphalt and bitumen roof structure is even hotter than neighboring roof regions. These "hot spots" weaken the roof membrane, accelerate aging of the roof, and require additional maintenance to avoid leaks that can cause structural failure if not repaired in a timely manner. The industry continues to seek a panelized roof system that does not create "hot spots".

BRIEF SUMMARY OF THE INVENTION

A first embodiment of the present invention is a roofing system in which a series of plywood or oriented strand hoard decking panels are nailed over supporting sub-purlins, joist girders and trusses or other supporting members. At the regions near the building side walls, and sometimes throughout the diaphragm, metal tie straps are secured over portions of the decking panels to create tension/compression connections at the abutting edges and ends of the decking panels. A radiant reflective sheeting is secured over the metal tie strap. Then, the decking panels with radiant-reflective sheeting-covered metal tie straps are covered with a multi-component roofing membrane, such as one or more layers of felt, nylon strapping, tar, roofing shingles or roofing roll material, to form the industrial roofing system. Such roofing systems are frequently installed for large warehouse structures where the flat roof expanse may extend several acres.

The improvement comprises interposing radiant reflective sheeting or panels over each of the metal tie straps to reflect at least some radiant energy to prevent the metal tie straps from heating to a greater extent than adjacent roof portions without such metal strapping. The radiant reflective sheeting will reflect at least some of the radiant heat, such as from sunlight, away from the metal tie straps. This cool seal over such tie straps prevents or diminishes heat build up at the metal tie straps, which otherwise can lead to uneven heating of the roofing surface at the tie straps (i.e., "hot spots") that ultimately can weaken the roofing membrane at such strapping.

The radiant reflective or cool seal sheeting or may be a panel of a single reflective material, such as a bleached or white board coated for water resistance. Alternatively, the radiant reflective sheeting may be a laminate construction. One such laminate includes a sheet of highly sized chipboard (i.e, paper or cardboard) that has been laminated to a sheet of solid bleached sulphate. The sheet of solid bleached sulphate has a film of LDPE on each surface. Lamination between the chipboard and the solid bleached sulphite sheet may be with asphalt. Preferably, a second solid bleached sulphate sheet is laminated to the other side of the highly sized chip board with a water-resistant adhesive or glue. Such second solid bleached sulphate sheet is coated with polyethylene.

A second embodiment of the invention is a method for reducing heat build-up on an industrial roofing system at the regions of the roof in which metal tie straps are installed for tension/compression connection of plywood or oriented strand board decking panels. With such method, a radiant reflective sheeting or panel is installed over the metal tie strap before the roofing membrane is installed to form the roofing system. Such roofing membrane may be a multi-component membrane comprising felt, nylon strapping, optionally other fasteners besides such nylon strapping, tar and/or roofing shingles or roofing roll material. The radiant reflective sheeting may be secured with fasteners to the plywood or oriented strand board decking panels, such as staples, preferably hammer tacker staples. Preferably, the radiant reflective sheeting has a length longer than the length of the metal tie strap and a width wider than the metal tie strap so that the radiant reflective sheeting completely covers the metal tie strap and can be stapled directly to the decking panels.

DETAILED DESCRIPTION OF THE INVENTION

Figure 1:
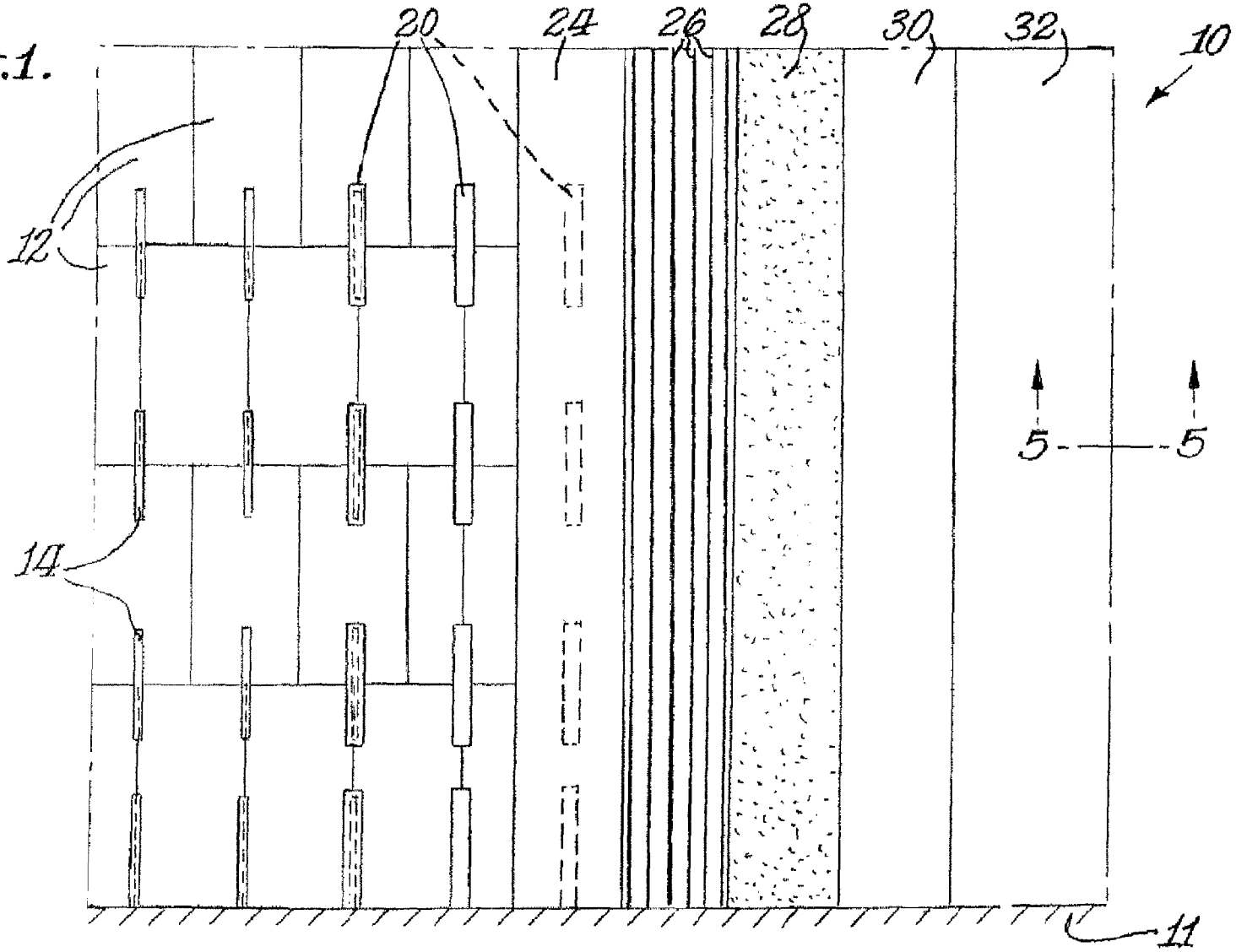
FIG. 1 is a top plan view in partial break-away showing a roofing system for a flat industrial roof.

In accordance with one embodiment of the present invention, a roofing system 10, such as for an industrial roof or a warehouse, includes a number of layers that may be described with reference to FIG. 1. In the industry, such roofing system may be referred to as a built-up roof or "BUR". Referring to FIG. 1, the roofing system 10 includes a series of plywood or oriented strand board decking panels 12 that are attached to subpurlins, trusses or joist girders 13 or support structure (see FIG. 5) by roofing nails (not shown). The decking panels 12 usually comprise flat sheets of plywood or oriented strand board that are arranged in staggered rows so that side edges of each row abut adjacent sheets (other panel edges), and the end edges of adjoining rows abut sheets from another row (continuous edges). Industrial roofing systems can extend for great expanses, such as an acre or several acres or more. In FIG. 1, one building sidewall 11 is shown, with the remaining portion of the Figure marked to indicate indefinite length and width.

Most frequently, at the portions of the roofing system 10 nearest to a sidewall 11, additional support to the roof system structure is imparted by a series of metal tie straps 14 applied at the edges and/or at the intermediate sections of the decking panels 12. Building codes in each region may vary. In California, such continuity ties (metal tie straps or strapping 14) are installed to create tension/compression connection in the roofing system nearest to a sidewall 11 and through a diaphragm. Sometimes a roof plan will call for metal tie straps to be installed throughout the roof decking. Multiple metal tie straps 14 are shown as applied to the roofing system 10 in FIG. 1. The metal tie straps can be galvanized steel other roof-approved metal that can withstand seismic forces and high wind resistance.

Figure 2:
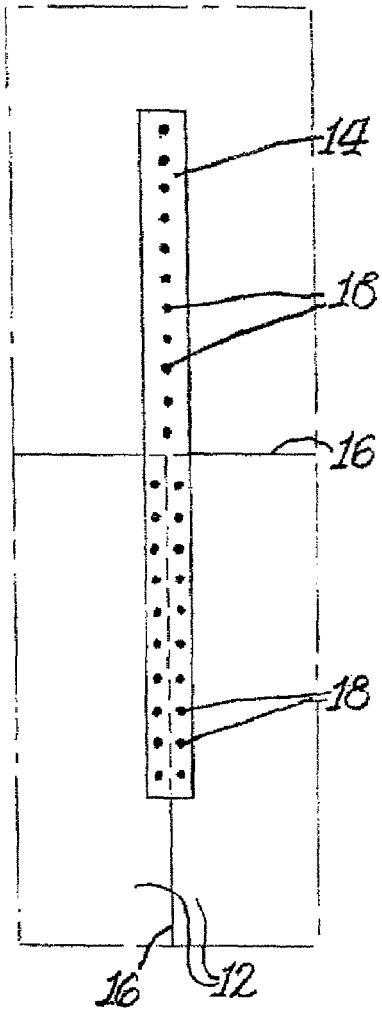
FIG. 2 is a top plan view of a metal tie strap attached with nails driven through plywood decking or oriented strand board sheets and imbedded into two framing members to create tension/compression connections.

Referring to FIG. 2, the metal tie strap 14 is nailed with hardened or standard nails 18 (such as an N16 (2.5×0.1620 inch) or a 10D (2.5×0.148 inch)) to a joined region at which the side or end edges 16 of two decking panels 12 abut with one another. Such metal tie straps 14 create a tension/compression connection between the panels. Generally, the metal tie straps will have a width of about 2.0 inches and a length of about 4 feet. Different suppliers may offer wider or longer metal strapping. Longer and wider metal tie straps can create higher tension/compression connection.

Although galvanized steel has a radiant reflectance or emissivity higher than the asphalt and tar roofing materials conventionally applied over such metal in built-up roofing systems, it has been found that the metal tie straps 14 conduct radiant heat and transfer such heat to adjoining material, such as the roof membrane. In particular, the regions of the roofing system 10 at which metal tie straps 14 are applied can build up heat to a greater extent than other regions of the roofing system. This heat build up we have called "hot spots". Although metal tie straps 14 are intended to help rigidify the roof system 10 and create tension/compression connections from the wall and/or throughout the roof diaphragm, we have found that when "hot spots" form, the roof structure is weakened, leading to the need for additional maintenance to prevent leaks. To overcome the problem with "hot spots", we have developed a roofing system that helps to reduce the build up of radiant heat at the metal tie straps 14.

Figure 3:
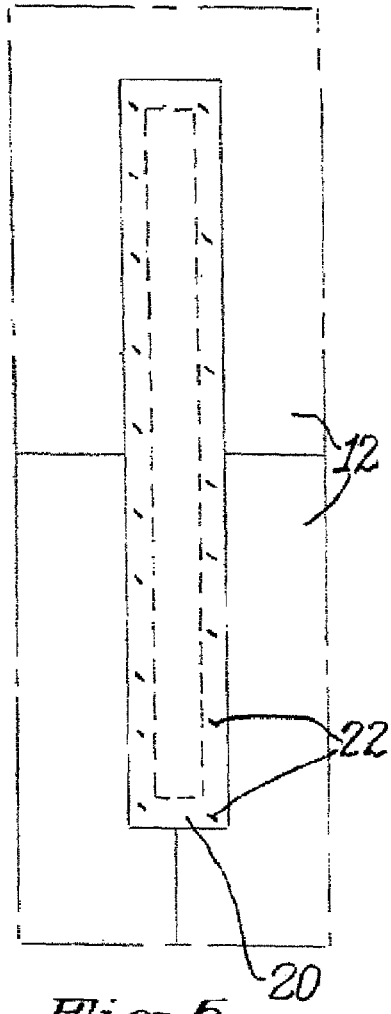
FIG. 3 is a top plan view of a radiant reflective sheeting over the metal tie strap of FIG. 2.

Referring next to FIGS. 1 and 3, a radiant reflective sheeting 20 is secured over the metal tie strap 14. In the embodiment shown in FIGS. 1 and 3, the radiant reflective sheeting or panel 20 has a length longer than the metal tie strap and a width wider than the metal tie strap 14. The radiant reflective panel 20 can be secured directly to the decking panels 12 with staples 22, such as hammer tacker staples. Alternative fasteners may be used if appropriate.

The radiant reflective sheeting 20 can be any light and radiant heat reflective material that will remain substantially in tact for a reasonable service life when subjected to the harsh conditions present on industrial roofing systems. Preferably, the radiant reflective sheeting 20 is white or off-white in color. We have found that a light-weight material comprising a bleached or white board coated for water resistance or impermeability can be used. Alternatively, the radiant reflective sheeting may be a light-weight laminate. One such laminate includes a sheet of highly sized chipboard (i.e, paper or cardboard) that has been laminated to a sheet of solid bleached sulphate. The sheet of solid bleached sulphate has a film of LDPE on each surface. Lamination between the chipboard and the solid bleached sulphite sheet may be with asphalt. Preferably, a second solid bleached sulphate sheet is laminated to the other side of the highly sized chip board with a water-resistant adhesive or glue. Such second solid bleached sulphate sheet is coated with polyethylene.

Figure 5:
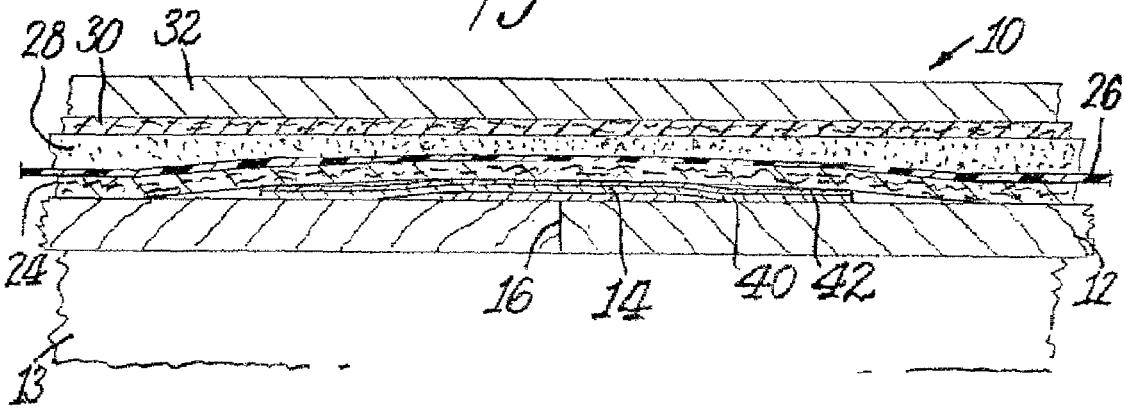
FIG. 5 is a side elevational view in cross section taken along line 5-5 in FIG. 1 showing the roofing system of FIG. 1.

Referring to FIG. 5, the highly sized chipboard sheet forms a first ply 40 and the solid bleached sulphate sheet with LDPE coating forms the second ply 42. An asphalt layer, not shown in FIG. 5, holds the laminate together to form the radiant reflective panel 20. While not shown in FIG. 5, preferably, a second solid bleached sulphate sheet is applied to the opposite surface of the highly sized chipboard sheet so that the laminate has white or reflective surfaces on both sheet surfaces forming the radiant reflective sheeting.

The highly sized chipboard may have a thickness of about 0.010 to 0.015 inch, and a weight from 40 to 50 lbs/MSF. The first sheet of solid bleached sulphate may have a thickness of 0.050 to 0.075 inch and the LDPE film applied to each side may have a thickness from 0.010 to 0.025 inch, such that the sheet weighs about 90 lbs/MSF. Asphalt to form the laminate may be applied to a coating weight of about 15 to 20 lbs/MSF. One suitable asphalt has 175 degree F. melt point and 535 degree F. flash point. The second solid bleached sulphate sheet may have the same thickness as the first sheet, and the water-resistant glue used to apply such second sheet to the highly sized chipboard may be applied at a coating weight of about 5 lbs/MSF. The material preferably is maintained as a flat sheet that may be cut to size.

Figure 4:
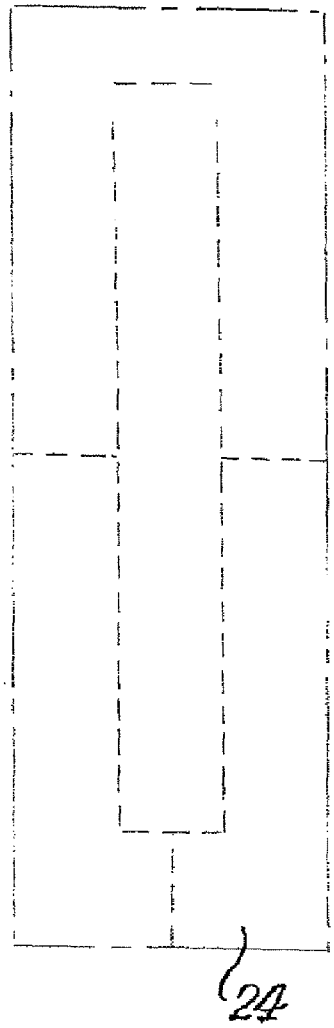
FIG. 4 is top plan view of a felt layer over the radiant reflective sheeting and plywood or oriented strand board sheets of FIG. 3.

Once the radiant reflective sheeting 20 has been installed over the metal tie strap 14, the remaining roofing system materials may be installed. Referring next to FIGS. 1 and 4, a first layer of roofing felt 24 is laid over the decking panels 12, and the radiant reflective sheeting or panels 20. Such roofing felt 24 is held in place by nylon strapping 26 that is stapled, nailed or tacked down over the roofing felt 24, with the fasteners penetrating the decking panels. The roofing felt may be held in place by other various fastener types that can be hand driven or applied with pneumatic air tools, with the fasteners penetrating the decking panels. Various pneumatic nailing machines are available, such as the RT2 REVOLUTION and the PLASTI-TACKER PLUS, both from National Nail Corp.

A hot tar coating 28 is then applied over the first roofing felt layer 24 and strapping 26 or other fasteners. A second roofing felt layer 30 is then laid over the hot tar coating 28. Thereafter, a layer of bitumen or asphalt roofing shingles or bitumen or asphalt roll roofing cover material 32 is secured over the second roofing felt layer 30.

Optionally, other roofing coatings, such as paints or other pigment-containing roof coatings, or resins or membranes or solar reflective structures or coatings, may be applied. Optionally, gravel or other loose surface materials may be positioned over the shingles or roll roofing.

FIG. 5 is a cross-sectional view taken along line 5-5 in FIG. 1. FIG. 5 shows all layers in one exemplary finished roofing system 10 according to the invention. The radiant reflective sheeting (or "cool seal" material) is shown installed over the metal strapping 14 and then covered with the remaining roofing felts, strapping, hot tar, and roofing shingles or roofing roll material.

While FIGS. 1-5 illustrate a built-up roofing system wherein decking panels are installed over subpurlins, the invention has application for roofing systems in which decking panels are installed over tube steel strut lines. In such alternative roofing system, the radiant reflective sheeting may be placed over an inverted cap sheet, or may replace the inverted cap sheet.

The present invention is not to be limited in scope by the specific embodiments described herein. Various modifications of the invention in addition to those described will become apparent to those skilled in the art from the foregoing description. Such modifications are intended to fall within the scope of the appended claims.

What is claimed:

1. A roofing system having a series of decking panels over supporting members in which one or more metal tie straps are installed over portions of the decking panels, with said panels and straps thereafter covered with one or more layers of felt, tar and roofing shingles or roofing roll material, characterized by:

a radiant reflective sheeting secured to over the metal tie strap, the one or more layers of felt, tar and roofing shingles or roofing roll material are secured over said radiant reflective sheeting and said tie strap, wherein said radiant reflective sheeting comprises a laminate of a highly sized chipboard sheet laminated to a solid bleached sulphite sheet with an LDPE film on each surface.

2. The roofing system of claim 1, wherein the radiant reflective sheeting is stapled to the decking panels.

3. The roofing system of claim 1, wherein the radiant reflective sheeting covers the metal tie strap surface.

4. The roofing system of claim 1, wherein the metal tie strap has a length and a width and a thickness, and the radiant reflective sheeting has a length longer than the length of the metal tie strap and width wider than the metal tie strap.

5. The roofing system of claim 1, wherein the laminate is formed with asphalt between the sheets.

6. The roofing system of claim 1, wherein the radiant reflective sheeting further comprises a second solid bleached sulphite sheet that has been coated with polyethylene laminated to the highly sized chipboard sheet.

7. The roofing system of claim 6, wherein the second solid bleached sulphite sheet is adhered to the highly sized chipboard sheet with an adhesive or glue.

8. A roofing system, comprising:

two or more decking panels laid side to side or end to end with abutting edges;

at least one metal tie strap secured to at least a portion of the abutting edges of the decking panels, wherein said metal tie strap has a length and a width and a thickness;

a radiant reflective sheeting over the metal tie strap, wherein the radiant reflective sheeting comprises a laminate of a highly sized chipboard sheet laminated to a solid bleached sulphite sheet with an LDPE film on each surface; and one or more layers of roofing felt, roofing tar and/or roofing shingles or roofing roll disposed over the radiant reflective sheeting and at least a portion of the decking panels.

9. The roofing system of claim 8, wherein the laminate is formed with asphalt between the sheets.

10. The roofing system of claim 9, wherein the radiant reflective sheeting further comprises a second solid bleached sulphite sheet that has been coated with polyethylene laminated to the highly sized chipboard sheet.

11. The roofing system of claim 10, wherein the second solid bleached sulphite is adhered to the highly sized chipboard sheet with an adhesive or glue.

12. A method for reducing heat build up at a metal tie strap region of a panelized or built up roofing system, comprising:

installing a radiant reflective sheeting over the metal tie strap before applying felt or tar or roofing shingles or roofing roll over the metal tie strap, wherein the radiant reflective sheeting comprises a laminate of a highly sized chipboard sheet laminated to a solid bleached sulphite sheet with an LDPE film on each surface.

13. The method of claim 12, wherein the laminate is formed with asphalt between the sheets.

14. The method of claim 12, wherein the radiant reflective sheeting further comprises a second solid bleached sulphite sheet that has been coated with polyethylene laminated to the highly sized chipboard sheet.

15. The method of claim 14, wherein the second solid bleached sulphite is adhered to the highly sized chipboard sheet with an adhesive or glue.

16. The method of claim 12, wherein the metal tie strap has a length and a width and a thickness and the radiant reflective sheeting has a length longer than the metal tie strap and a width wider than the metal tie strap.

17. The method of claim 12, wherein the radiant reflective sheeting is secured over the metal tie strap with staples.

* * * * *

UNITED STATES PATENT AND TRADEMARK OFFICE

CERTIFICATE OF CORRECTION

PATENT NO. : 7,726,087 B2
APPLICATION NO. : 11/424590
DATED : June 1, 2010
INVENTOR(S) : Francis H. Tankersley, Jr. et al.

It is certified that error appears in the above-identified patent and that said Letters Patent is hereby corrected as shown below:

In Claim 1, at Column 5, line 33, delete "over."

Signed and Sealed this

Third Day of August, 2010

David J. Kappos

David J. Kappos
*Director of the United States Patent and Trademark Office*